US006981353B2

(12) United States Patent
Haberstroh et al.

(10) Patent No.: US 6,981,353 B2
(45) Date of Patent: Jan. 3, 2006

(54) STRAPPING MACHINE WITH STRAP FEEDING AND TENSIONING SYSTEM WITH AUTOMATIC REFEED

(75) Inventors: James A. Haberstroh, Vernon Hills, IL (US); Timothy B. Pearson, Antioch, IL (US); Lawrence G. Sickels, Spring Grove, IL (US)

(73) Assignee: Illinois Tool Works, Inc., Glenview, IL (US)

( * ) Notice: Subject to any disclaimer, the term of this patent is extended or adjusted under 35 U.S.C. 154(b) by 0 days.

(21) Appl. No.: 10/600,198

(22) Filed: Jun. 20, 2003

(65) Prior Publication Data

US 2004/0255552 A1 Dec. 23, 2004

(51) Int. Cl.
*B65B 57/02* (2006.01)

(52) U.S. Cl. ..... 53/64; 53/52; 53/589; 53/590; 100/26; 100/29; 100/32

(58) Field of Classification Search ..... 53/52, 53/591, 590, 589, 582, 64; 100/26, 29, 32
See application file for complete search history.

(56) References Cited

U.S. PATENT DOCUMENTS 4,559,767 A * 12/1985 Takami ..... 53/589
4,569,186 A * 2/1986 Mori et al. ..... 53/589
4,912,912 A * 4/1990 Tagomori ..... 53/589
5,083,412 A * 1/1992 Sakaki et al. ..... 53/399
5,155,982 A * 10/1992 Boek et al. ..... 53/589
5,299,407 A * 4/1994 Schuttler et al. ..... 53/399
5,333,438 A * 8/1994 Gurak et al. ..... 53/399
5,379,576 A * 1/1995 Koyama ..... 53/589
5,560,187 A * 10/1996 Nagashima et al. ..... 53/589
6,032,440 A * 3/2000 Ludtke ..... 53/589
6,041,698 A * 3/2000 Chin-Chang et al. ..... 100/26
6,076,338 A * 6/2000 Maeda et al. ..... 53/589
6,173,557 B1 * 1/2001 Kuei ..... 53/589
6,568,158 B2 * 5/2003 Shibazaki et al. ..... 53/582
6,655,117 B2 * 12/2003 Hoshino ..... 53/589

* cited by examiner

*Primary Examiner*—Scott A. Smith
*Assistant Examiner*—Gloria R. Weeks
(74) *Attorney, Agent, or Firm*—Mark W. Croll, Esq.; Donald J. Breh, Esq.; Welsh & Katz, Ltd.

(57) ABSTRACT

A strapping machine feed system for automatically detecting a strap error or fault, thereby stopping strap retraction or take-up, and refeeding the strap into the strapping head following the error or fault. The feed system includes a pair of tensioning wheels disposed along a strap path proximal a strap supply, and a pair of feed wheels, defining a nip therebetween, disposed along the strap path proximal the strapping head. A feed wheel drive and a tensioning wheel drive are respectively connected to the feed wheels and the tensioning wheels. A sensor disposed along the strap path generates a signal to the feed wheel drive and tensioning wheel drive, indicating movement or lack of movement along the strap path, thus causing the feed wheels or tensioning wheels to rotate in both a forward and reverse direction.

17 Claims, 3 Drawing Sheets

STRAPPING MACHINE WITH STRAP FEEDING AND TENSIONING SYSTEM WITH AUTOMATIC REFEED

BACKGROUND OF THE INVENTION

The present invention is directed to a strapping machine feed system. More particularly, the present invention is directed to a strapping machine feed system in which strap is refed following a strap error or fault.

Strapping machines are well known in the art for securing straps around loads. One type of known strapper is a stationary unit that includes a strapping head or weld head and drive mechanism mounted within a frame. A chute is mounted to the frame, through which the strapping material is fed. In a typical arrangement, a table-top or work surface is likewise mounted to the frame.

In a typical stationary strapper, the chute is mounted from about the work surface, and the strapping head is mounted below the work surface. Strap is fed from a source or dispenser to the strapping or weld head. The strapping head provides a number of functions. First, it includes a plurality of grippers for gripping portions of the strap during the course of a strapping operation. The strapping head also includes a cutter to cut the strap from a strap source or supply. Last, the strapping head includes a sealer to seal an overlying course of strapping material onto itself. This seal is commonly referred to as a weld and is effected by heating overlying courses of the strap by use of a vibrating element or a heated element.

Strapping material is fed from the dispenser into the strapping head first via a pair of infeed wheels and second via a feed assembly. The infeed wheels are typically located immediately inside of the strapping machine (e.g., inside of an enclosure or cabinet). The infeed wheels facilitate smoothly feeding the strapping material into the strapper and supplying strapping material into the slack box. The slack box is an area between the infeed wheels and the strapping head that is used to store a length of "slack" strapping material for use by the strapping head and is also an area for storing take-up strap that has been rewound or tensioned around the load.

The feed assembly includes a pair of tensioning wheels and a pair of feed wheels. The tensioning wheels are locate downstream of the infeed wheels, and a guide extends between the tensioning and feed wheels. The slack box is disposed about the guide area, between the infeed and tensioning wheels.

The feed wheels are located between the tensioning wheels and the strapping head. The feed wheels feed the strap material into the strapping head (and around the strap chute). A guide is disposed between the tensioning wheels and the feed wheels to provide a pathway for the strap as it is fed into the strapping head by the feed wheels and as it is pulled from the strapping head (and from around the chute) by the tensioning wheels.

In the event a strap error occurs, as by a failure of the gripper to grip the leading end of the strap, during the tensioning cycle, the strap will be over-retracted or over-pulled by the tensioning wheels. When this occurs, the strap is pulled rearwardly to the extent that is has essentially pulled out of the strap path. Pulling the strap from the path results in a machine fault. Operator attention is then required to stop machine operation and refeed strap into the feed system to resume operation.

Accordingly, there is a need for a strapping machine having a strap feeding and tensioning system with automatic refeed. Desirably, such a system automatically detects a strap error or fault, stops strap retraction or take-up and refeeds the strap into the strapping head following that error or fault. More desirably, such a system refeeds the strap into the strapping head without additional parts or assemblies beyond those employed for feeding and tensioning the strap material during normal machine operations.

BRIEF SUMMARY OF THE INVENTION

A feed system for a strapping machine automatically detects a strap error or fault, stops strap retraction or take-up and refeeds the strap into the strapping head following that error or fault. Such a system is configured for use in a strapping machine of the type having a strap supply, a strap chute and a strapping head disposed between the strap supply and the chute.

The feed system defines a strap path from the strap supply to the strapping head. A pair of tensioning wheels is disposed along the strap path proximal the strap supply. In a present embodiment, the tensioning wheels are movable into and out of engagement with one another. A pair of feed wheels is disposed along the strap path proximal the strapping head. The feed wheels define a nip therebetween.

A feed wheel drive is operably connected to one of the feed wheels and a tensioning wheel drive is operably connected to one of the tensioning wheels. Preferably, the feed and tensioning wheel drives are reversible motors. The other of the feed and tensioning wheels are idler or pinch wheels.

A sensor is disposed along the strap path for generating a signal to indicate a movement or a lack of movement of the strap material along the strap path.

In a strapping cycle, the strap material is conveyed around the strap chute by forward rotation of the feed wheels and is retracted around the load by reverse rotation of the feed wheels. The strap is tensioned around the load by forward rotation of the tensioning wheels. Forward rotation of the tensioning wheels commences upon receipt of the lack of movement of strap material signal following retracting the strap material.

When, following reverse rotation of the feed wheels for retracting the strap material, the machine is in a faulted strap condition (by the sensor failing to generate a lack of movement signal), the feed wheels stop rotation, and the tensioning wheels rotate in a reverse direction to convey the strap material into the nip between the feed wheels.

In a current embodiment, the sensor is disposed proximal the idler feed wheel to sense the movement and lack of movement of the idler feed wheel. The movement and lack of movement of the idler feed wheel correspond to the movement and lack of movement of the strap material signals, respectively.

Preferably, the tensioning wheels are moved out of engagement with one another when the strap material is conveyed around the strap chute and when strap material is retracted around the load. The tensioning wheels are moved into engagement with one another when the strap material is tensioned around the load and when the strap is refed into the feed wheel nip following the faulted strap condition.

The tensioning wheels are moved into and out of engagement with one another by a linkage that is operably connected to the pinch tensioning wheel for moving an axis of rotation of the pinch tensioning wheel toward and away from the driven tensioning wheel. The pinch tensioning wheel is mounted to an eccentric shaft that is operably connected to the linkage.

A strapping machine having a feed system that automatically detects a strap error or fault, stops strap retraction or take-up and refeeds the strap into the strapping head following that error or fault is also disclosed.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
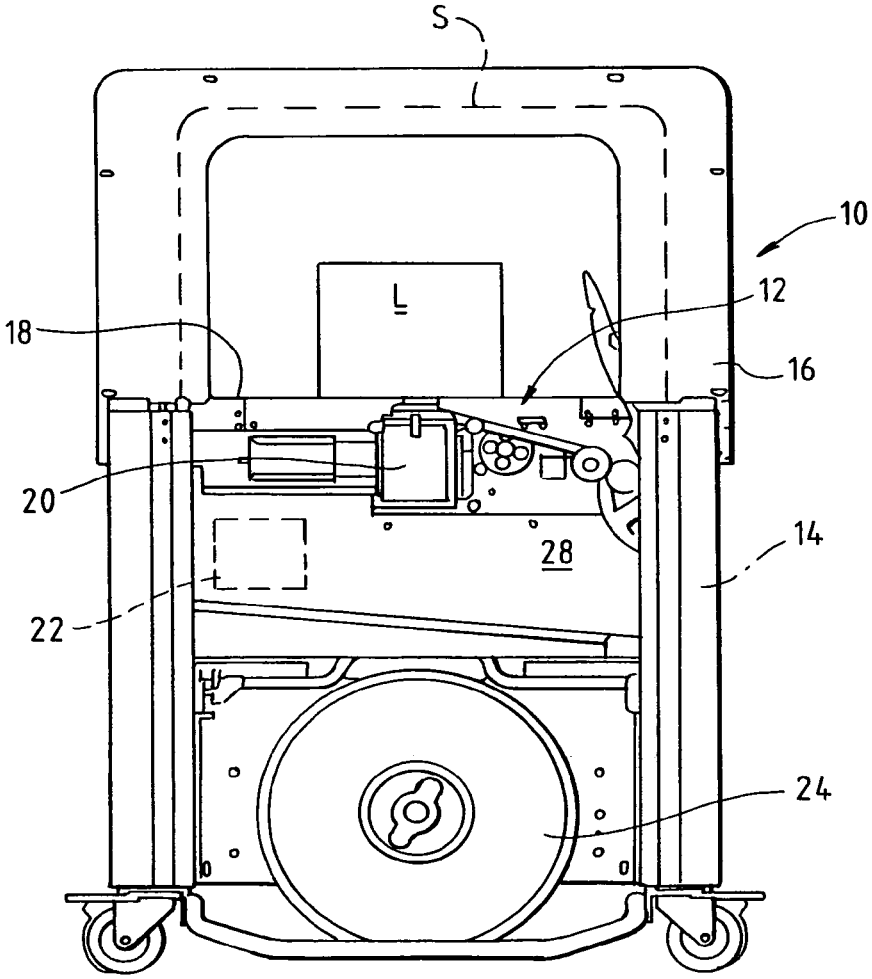
FIG. 1 is a front view of an exemplary strapping machine having a strap path access guide embodying the principles of the present invention.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention", relates to a requirement of the United States Patent Office, and does not imply, nor should be inferred to limit the subject matter disclosed herein.

Referring to the figures and in particular FIG. 1, there is shown a strapping machine 10 having a feed system with automatic refeed 12 embodying the principles of the present invention. The strapping machine 10 includes, generally, a frame 14, a strap chute 16 and a table top or work surface 18. The feed assembly 12 and a strapping head 20 are mounted below the work surface 18. A controller 22 provides automatic operation and control of the strapper 10.

The strapping head 12 receives strapping material S from a dispenser 24. The strap S is fed or pulled from the dispenser 24 by infeed wheels 26. In a typical arrangement, the infeed wheels 26 are mounted immediately inside of and within the machine 10. Strap S is conveyed from the infeed wheels 26 to the feed assembly 12 (past a slack box 28). The slack box 28 is used as a "storage" region for strap S that has been fed into the machine 10 but has not yet been pulled into the strapping head 20, and for strap S that has been taken-up from around the load L, as during the take-up or tensioning cycles.

The feed assembly 12 includes two pairs of wheels, namely a pair of feed wheels 30, 32 and a pair of tensioning wheels 34, 36. One of the feed wheels 30 is driven and the other is an idler or pinch wheel 32. Likewise, one of the tensioning wheels 34 is driven and the other is an idler or pinch wheel 36. The feed wheels 30, 32 are located proximal the strapping head 20, and the tensioning wheels 34, 36 are located proximal the slack box 28 and infeed wheels 26. A lower guide 38 extends between infeed wheels 26 and the tensioning wheels 34, 36. An upper guide 40 extends between the tensioning wheels 34, 36 and the feed wheels 30, 32, a portion of which guide 40 also extends beyond the feed wheels 30, 32 to the strapping head 20. A portion 40*a* of the upper guide 40 is pivotable (as shown by comparison of FIGS. 2 and 3) to provide ready access to the strap path P. The driven feed wheel 30 and the driven tensioning wheel 34 are operably connected to reversible motors 42, 44 to drive the wheels 30, 34 in both (i.e., clockwise and counter-clockwise) directions.

The driven feed and tensioning wheels 30, 34 are fixed relative to the frame 14. The idler (or pinch) feed wheel 32 is biasedly mounted to the guide 40. During the strapping cycle, the idler feed wheel 32 is maintained in contact with the driven feed wheel 30. A stall sensor 46 is located proximal the idler wheel 32 to monitor (and provide a signal) upon indication that the idler wheel 32 has stalled or stopped rotating.

Unlike the idler feed wheel 32, the pinch tensioning wheel 36 is mounted to an eccentric shaft 48 that is in turn operably connected, by a linkage 50, to a cam 52 in the strapping head 20. This cammed arrangement is configured to bring the pinch tensioning wheel 36 into contact with (i.e., to engage) the driven wheel 34 and to separate (i.e., disengage) the wheels 34, 36 from one another. In this manner, the pinch wheel 36 is moved into and out of engagement with the driven tensioning wheel 34 to drive or "idle" the strap S.

Briefly, in operation, there are three portions or sub-cycles of a normal strapping cycle. The first portion is the feed portion of the strapping cycle, during which strap S is "pulled" by the feed wheels 30, 32, conveyed though the strapping head 20, around the strap chute 16 and back to the strapping head 22. The cycle then progresses to the take-up portion of the cycle which is when the strap S is released from the chute 16 and is taken-up at high speed until it contacts or lies on the load L. Following the take-up portion of the cycle, the machine 10 progresses into the tensioning portion of the strapping cycle, during which the strap S is tensioned or pulled tight around the load L.

Figure 2:
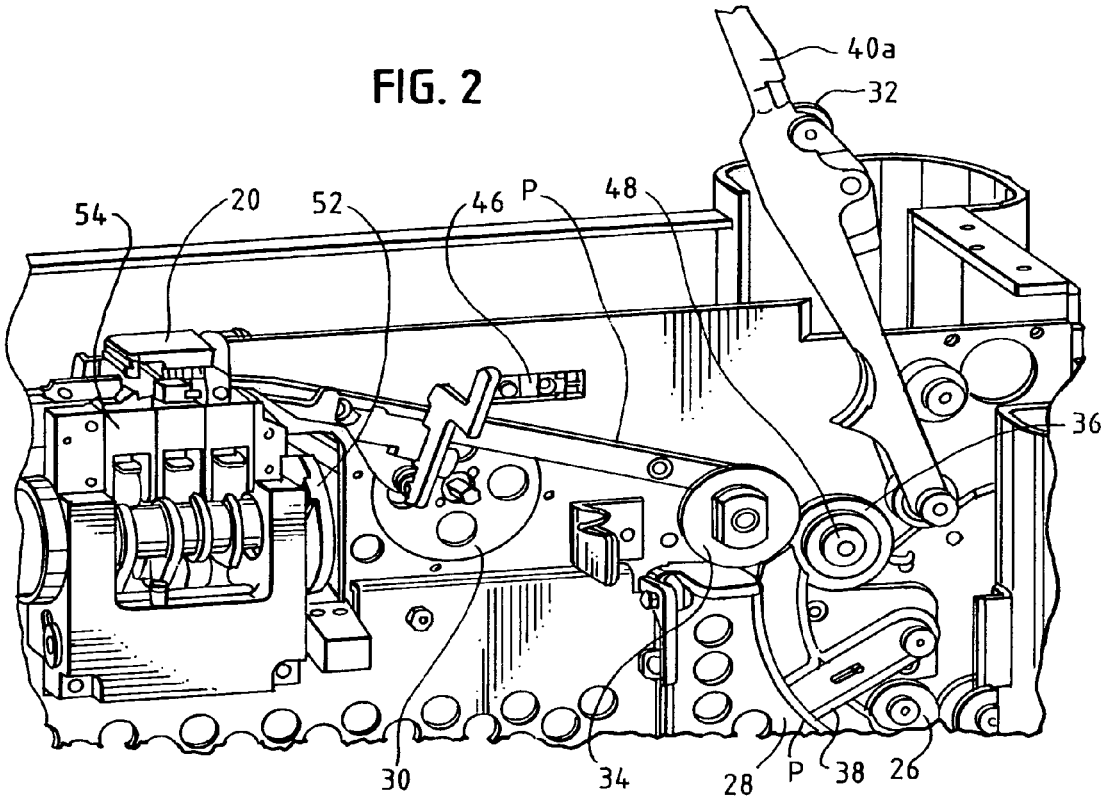
FIG. 2 is a perspective illustration of the front of the strapping machine showing the strapping machine feed assembly with a strap path access guide in the open position for ease of illustration.

The following discussion is provided for purposes of understanding the operating modes and relationships between the various components. During the feed portion of the cycle, the feed wheels 30, 32 rotate in a "forward" direction (as seen in FIG. 2, the driven wheel 30 rotates counter-clockwise), with the idler wheel 32 rotating by virtue of the movement of strap S between the driven 30 and idler 32 wheels. During the feed portion of the cycle, the tensioning wheels 34, 36 are separated (or open) from one another (by the strapping head cam 52-linkage 50-eccentric shaft 48 arrangement) to permit the feed wheels 30, 32 to "pull" the strap S.

Once the strap S moves around the chute 16 and back to the strapping head 20, the lead end of the strap S is gripped by a gripper 54 in the strapping head 20. Upon sensing that the strap S is gripped, the machine 10 progresses to the take-up portion of the cycle. In take-up mode, the strap chute 16 opens to allow the strap S to be pulled to the load L. The feed wheels 30, 32 reverse (the tensioning wheels 34, 36 are still separated or open) and the strap S is pulled from the chute 16 on to the load L. Take-up is carried out at a high speed but at a low force. As such, once the strap S is fully pulled to the load L (but not yet tensioned), the strap S will "stall". By virtue of the dependence of rotation of the feed idler wheel 32 on the movement of the strap S, when the strap S "stalls", so does the idler wheel 32. This stall is sensed by the stall sensor 46.

Upon sensing a stall in the idler wheel 32, the machine 10 progresses to the tensioning portion of the strapping cycle. In this portion of the cycle, the strapping head 20 indexes (which moves the cam 52), which in turn moves the linkage 50 to bring the tensioning wheels 34, 36 into contact, The tensioning motor 44 then actuates (rotating in a forward direction) to tension the strap S around the load L. Upon reaching a predetermined tension, the tensioning motor 44 stops (stopping the tensioning wheels 34, 36) and the strap S is sealed and cut. The machine 10 then resets and recommences the strapping cycle (per the controller 22).

Figure 3:
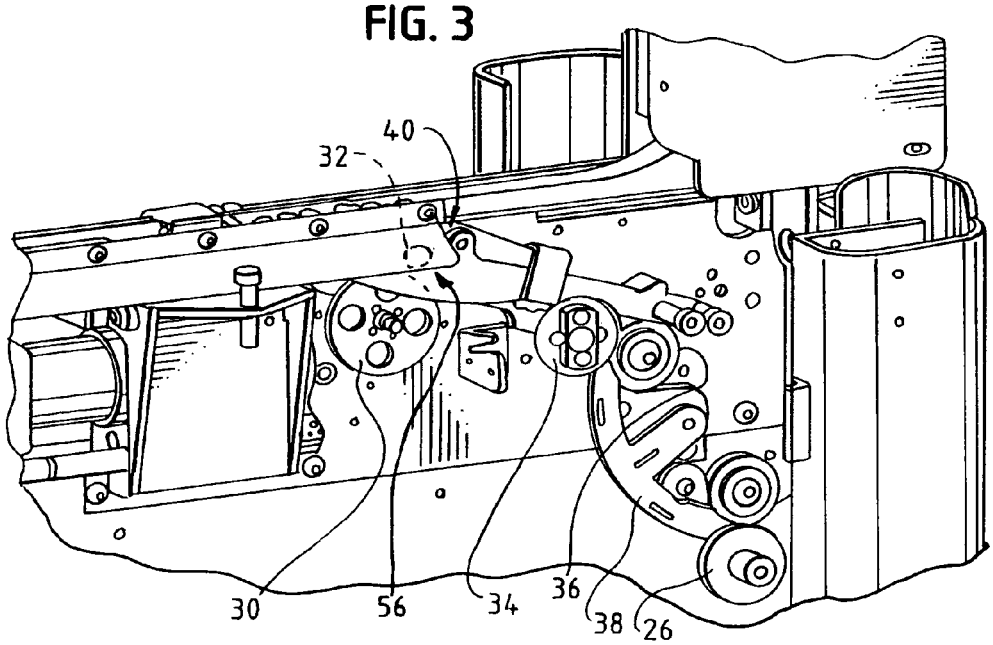
FIG. 3 is a perspective illustration similar to FIG. 2 showing the access guide in the closed or operating position.
Figure 4:
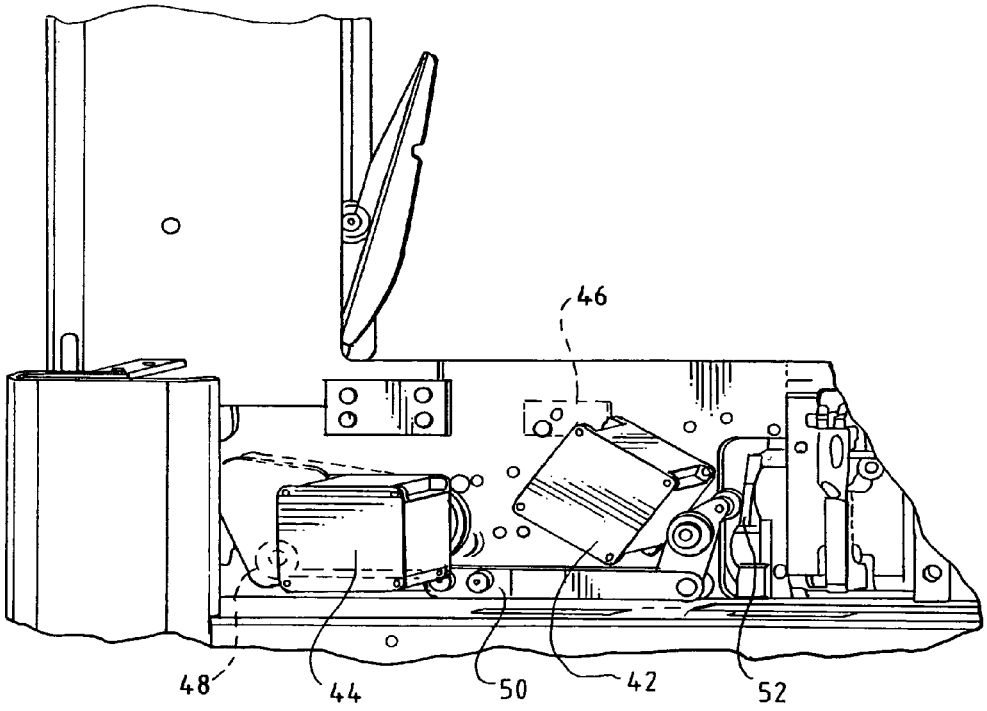
FIG. 4 is a perspective illustration of the rear of the strapping machine.

When a strap fault occurs in which the leading end of the strap S is not properly gripped at the strapping head 20, the machine 10, in the course of the strapping cycle will progress to the take-up portion of the cycle. When the stall sensor 46 fails to sense a stall within a predetermined period of time, for example, two seconds, the feed wheels 30, 32 stop the (reversed) take-up rotation and the machine 10 indexes to an "off-normal" refeed mode. In the refeed mode, the feed wheels 30, 32 are stopped and the tensioning wheels 34, 36 are engaged with one another (by operation of the strapping head cam 52-link 50-eccentric shaft 48 arrangement). However, in this mode the tensioning wheels 34, 36 are rotated in a reverse direction (the driven tensioning wheel 34 rotates counter-clockwise as seen in FIGS. 2 and 3) to boost the strap S into the nip 56 formed by the feed wheels 30, 32. In this manner, the strap S is refed into the feed wheels 30, 32 following a strap S fault. The strap S, when sensed at the idler feed wheel 32 (by movement of the wheel 32 due to the pushing or urging of the strap S into the nip 56), generates a signal to the machine controller 22 indicating that the machine 10 is ready to commence operation. The controller 22 is then reset and the machine 10 is ready for operation.

The present feed system with automatic refeed 12 provides a number of advantages over known strapping machine systems. One such advantage is the ability to automatically refeed strap S to the strapping head 20 following a faulted strap condition. Those skilled in the art will readily recognize and appreciate the advantage that such as system provides to, among other things, enhance the operational efficiency and reduce the machine "down-time" that might otherwise occur.

All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A feed system for a strapping machine of the type having a strap supply and a strap chute, the strapping machine including a strapping head disposed between the strap supply and the chute, the strapping machine configured to position, tension and seal a strap material around a load, the feed system comprising:

a strap path from the strap supply to the strapping head;

a pair of tensioning wheels disposed along the strap path proximal the strap supply;

a pair of feed wheels disposed along the strap path proximal the strapping head, the feed wheels defining a nip therebetween;

a feed wheel drive operably connected to one of the feed wheels and a tensioning wheel drive operably connected to one of the tensioning wheels, wherein the feed wheel drive and the tensioning wheel drive are reversible motors; and a sensor disposed along the strap path for generating a signal to indicate a movement or a lack of movement of the strap material along the strap path, wherein in a strapping cycle, the strap material is conveyed around the strap chute by forward rotation of the feed wheels, is retracted around the load by reverse rotation of the feed wheels and is tensioned around the load by forward rotation of the tensioning wheels, forward rotation of the tensioning wheels commencing upon receipt of the lack of movement of strap material signal following retracting the strap material, and wherein when, following reverse rotation of the feed wheels for retracting the strap material, in a faulted strap condition, the sensor fails to generate a lack of movement signal, the feed wheels stop rotation, and the tensioning wheels rotate in a reverse direction to convey the strap material into the nip between the feed wheels.

2. The feed system in accordance with claim 1 wherein the feed wheel having the drive operably connected thereto is a driven feed wheel and the other feed wheel is an idler feed wheel and wherein the tensioning wheel having the drive operably connected thereto is a driven tensioning wheel and the other tensioning wheel is a pinch tensioning wheel.

3. The feed system in accordance with claim 2 wherein the sensor is disposed proximal the idler feed wheel to sense the movement and lack of movement of the idler feed wheel, the movement and lack of movement of the idler feed wheel corresponding to the movement and lack of movement of the strap material signals, respectively.

4. The feed system in accordance with claim 3 wherein the tensioning wheels are movable into and out of engagement with one another, the tensioning wheels being movable out of engagement with one another when the strap material is conveyed around the strap chute and when strap material is retracted around the load, the tensioning wheels being moved into engagement with one another when the strap material is tensioned around the load and when the strap is refed into the feed wheel nip following the faulted strap condition.

5. The feed system in accordance with claim 1 wherein one of the tensioning wheels is a driven tensioning wheel and the other tensioning wheel is a pinch tensioning wheel, and including means for moving the tensioning wheels into and out of engagement with one another.

6. The feed system in accordance with claim 5 wherein the means for moving is a linkage operably connected to the pinch tensioning wheel for moving an axis of rotation of the pinch tensioning wheel toward and away from the driven tensioning wheel.

7. The feed system in accordance with claim 6 wherein the pinch tensioning wheel is mounted to an eccentric shaft operably connected to the linkage.

8. A feed assembly for a strapping machine of the type having a chute, and a strapping head disposed between the feed assembly and the chute, the strapping machine configured to position, tension and seal a strap material around a load, the feed assembly comprising:

a pair of tensioning wheels and a pair of feed wheels disposed along a strap path, the feed wheels defining a nip therebetween and rotating in a forward direction to feed the strap material into and around the chute and rotating in a reverse direction to retract the strap material and position the strap material around the load, the tensioning wheels rotating in a forward direction to tension the strap material around the load; and a sensor, wherein when, following reverse rotation of the feed wheels to retract the strap material, in a faulted strap condition, the sensor fails to generate a lack of movement signal, the feed wheels stop reverse rotation, and the tensioning wheels rotate in a reverse direction to convey the strap material to the nip between the feed wheels.

9. The feed assembly in accordance with claim 8 wherein the sensor is disposed along the strap path for generating a signal to indicate a movement or a lack of movement of the strap material along the strap path.

10. The feed assembly in accordance with claim 8 including means for moving the tensioning wheels toward and away from one another.

11. The feed assembly in accordance with claim 10 wherein the tensioning wheels are movable away one another when the strap material is conveyed around the strap chute and when the strap material is retracted around the load, the tensioning wheels being movable toward one another and rotating in a forward direction when the strap material is tensioned around the load and movable toward one another and rotating in a reverse direction when the strap is refed to the feed wheels following the faulted strap condition.

12. The feed assembly in accordance with claim 8 wherein one of the feed wheels is driven and one of the tensioning wheels is driven, the feed and tensioning wheels being driven by reversible motors.

13. A strapping machine of the type configured to position, tension and seal a strap material around a load, comprising:

a feed system;

a chute; and a strapping head disposed between the feed assembly and the chute;

the feed system including tensioning wheels and feed wheels disposed along a strap path, the feed wheels defining a nip therebetween and rotating in a forward direction to feed the strap material into and around the chute and rotating in a reverse direction to retract the strap material and position the strap material around the load, the tensioning wheels rotating in a forward direction to tension the strap material around the load; and a sensor, wherein when, following reverse rotation of the feed wheels to retract the strap material, in a faulted strap condition, the sensor fails to generate a lack of movement signal, the feed wheels stop reverse rotation, and the tensioning wheels rotate in a reverse direction to convey the strap material to the nip between the feed wheels.

14. The strapping machine in accordance with claim 13 wherein the sensor is disposed along the strap path for generating a signal to indicate a movement or a lack of movement of the strap material along the strap path.

15. The strapping machine in accordance with claim 13 including means for moving the tensioning wheels toward and away from one another.

16. The strapping machine in accordance with claim 15 wherein the tensioning wheels are movable away one another when the strap material is conveyed around the strap chute and when the strap material is retracted around the load, the tensioning wheels being movable toward one another and rotating in a forward direction when the strap material is tensioned around the load and movable toward one another and rotating in a reverse direction when the strap is refed to the feed wheels following the faulted strap condition.

17. The strapping machine in accordance with claim 13 including a pair of fed wheels and a pair of tensioning wheels, wherein one of the feed wheels is driven and one of the tensioning wheels is driven, the driven feed and tensioning wheels being driven by reversible motors.

* * * * *